US007832730B2

(12) United States Patent
Calderon

(10) Patent No.: US 7,832,730 B2
(45) Date of Patent: Nov. 16, 2010

(54) BOARD GAME

(76) Inventor: Octavio Calderon, 2717 76th Ave. SE., Apt. 203, Mercer Island, WA (US) 98040

( * ) Notice: Subject to any disclaimer, the term of this patent is extended or adjusted under 35 U.S.C. 154(b) by 0 days.

(21) Appl. No.: 11/668,995

(22) Filed: Jan. 30, 2007

(65) Prior Publication Data

US 2007/0176360 A1 Aug. 2, 2007

Related U.S. Application Data

(60) Provisional application No. 60/763,968, filed on Feb. 1, 2006.

(51) Int. Cl.
*A63F 3/00* (2006.01)

(52) U.S. Cl. ..... 273/243; 273/138.1; 273/141 R

(58) Field of Classification Search ..... 273/243, 273/141 R, 138.1
See application file for complete search history.

(56) References Cited

U.S. PATENT DOCUMENTS

| | | | | | |
|---|---|---|---|---|---|
| 2,322,564 | A | * | 6/1943 | Buckley et al. | 273/141 R |
| 3,226,122 | A | * | 12/1965 | Rogers | 273/142 R |
| 3,606,336 | A | * | 9/1971 | Krause | 273/272 |
| 3,997,167 | A | * | 12/1976 | Kratzer | 273/244 |
| 4,162,075 | A | * | 7/1979 | Iannucci | 273/256 |
| 4,711,453 | A | * | 12/1987 | Saint Ive | 273/268 |
| 5,013,069 | A | * | 5/1991 | Hardin | 283/48.1 |
| 5,429,371 | A | * | 7/1995 | Bledsoe | 273/272 |
| 5,553,853 | A | * | 9/1996 | Sackitey | 273/236 |

* cited by examiner

*Primary Examiner*—Vishu K. Mendiratta
(74) *Attorney, Agent, or Firm*—Black Lowe & Graham PLLC

(57) ABSTRACT

The present invention provides a board game. The board game includes a spinning device and an inner and outer ring of characters. The characters include at least one of a plurality of numbers or a plurality of letters located in one or more rings. Each player activates the spinning device. After the spinning device has stopped a master scorecard and the scorecard associated with the player who performed the activation of the spinning device are marked to identify what letter or number the spinning device is pointing to. The players rotate spinning of the spinning device until the master scorecard indicates that the game is over.

3 Claims, 6 Drawing Sheets

BOARD GAME

PRIORITY INFORMATION

This application claims the benefit of U.S. Provisional Patent Application Ser. No. 60/763,968 filed on Feb. 1, 2006 and is hereby incorporated by reference.

FIELD OF THE INVENTION

This invention relates generally to games and, more specifically, to board games.

BACKGROUND OF THE INVENTION

Many games of chance have employed a rotatable spinner/pointer to produce a random selection. However, many of these games of chance lose user interest, because they fail to keep the players engaged.

Therefore, there exists a need for a game of chance that engages the users to want to play more and more.

SUMMARY OF THE INVENTION

The present invention provides a board game. The board game includes a spinning device and an inner and outer ring of characters. The characters include at least one of a plurality of numbers or a plurality of letters located in one or more rings. Each player activates the spinning device. After the spinning device has stopped, a master scorecard and the scorecard associated with the player who performed the activation of the spinning device are marked to identify what letter or number the spinning device is pointing to. The players rotate activation of the spinning device until the master scorecard or a player's scorecard indicates that the game is over.

In one aspect of the invention, the game is over when one of the characters has been pointed to a predefined number of times. The predefined number of times is three times.

In another aspect of the invention, the game is over when the letters of a predefined word have been pointed to at least once. The predefined word is RICH.

In still another aspect of the invention, the game is over when a player's initials have been pointed to at least once from activation of the spinning device by the player.

In yet another aspect of the invention, the game is over when any of the above game ending determinations have been made.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
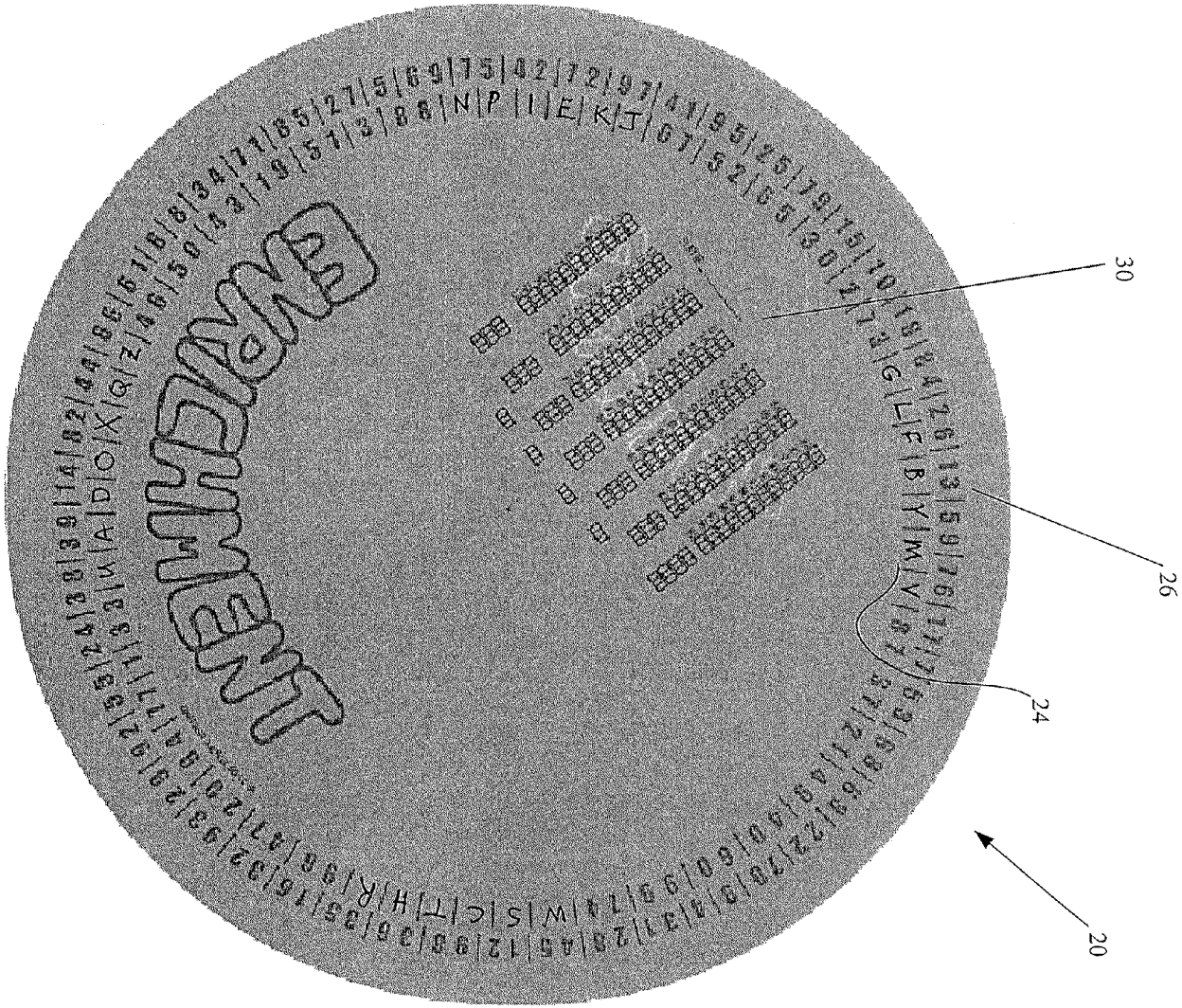
FIGS. 1 and 2 illustrate a game board formed in accordance with embodiment of the present invention.

FIG. 1 shows a top view of a game board 20 used in one embodiment. The game board 20 is made out of crafted wood. In alternate embodiments the game board 20 is made of plastic, card board, metal, and/or any other composite material known in the art. The game board 20 preferably includes an interior ring 24 of numbers and/or letters and an exterior ring 26 of numbers and/or letters. The game board 20 preferably, but not necessarily, includes a master scorecard 30.

Figure 2:
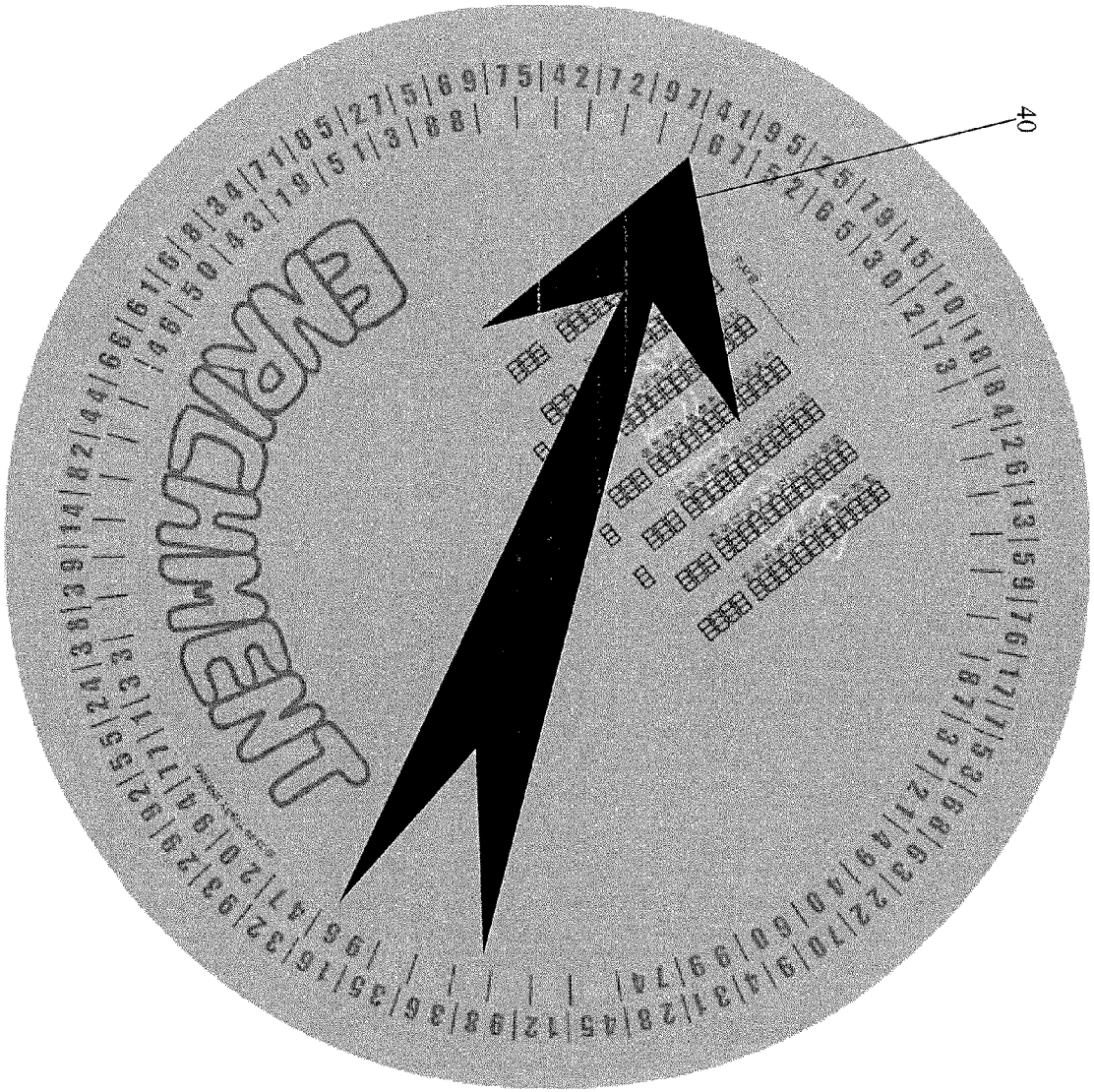

FIG. 2 shows an arrow 40 used, in one embodiment, as a spinning device. The arrow 40 is mounted in the middle of the game board 20 and is configured to spin when pushed by a player. Further, the arrow 40 includes a tip being the selection side for pointing at a number or letter located in the inner or outer rings 24, 26. In an alternate embodiment, the game board is configured such that it spins and the arrow 40 is stationary in the middle.

In alternate embodiments a physical game board is not required and the game is played using a computer program on a computer system. The game board in an alternate embodiment is mounted on a wall or is a self supporting structure. In an alternate embodiment, the game board has electronic lights and/or sensors.

Figure 3:
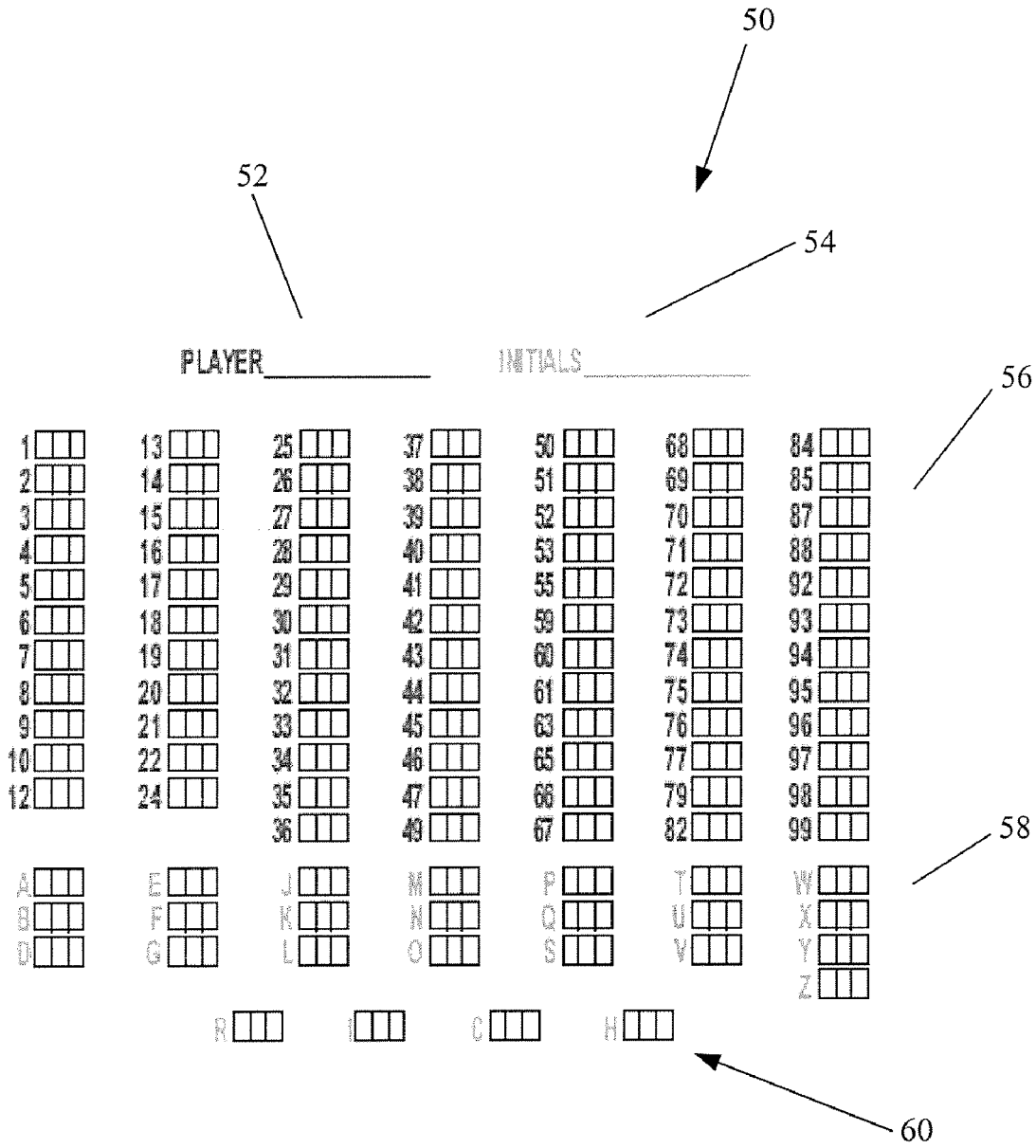
FIG. 3 illustrates an example scorecard formed in accordance with an embodiment of the present invention.

FIG. 3 shows a scorecard 50 similar to the scorecard 30 used in one embodiment. The scorecard 50 includes spaces 52, 54 to write the player's initials, a plurality of numbers section 56, a plurality of letters section 58, and/or word "RICH" section 60. In alternate embodiments other words and/or symbols are used. Next to each of the foregoing items 56-60 are three empty blocks. In alternate embodiments, there is at least one block next to each item. These blocks will be colored in while playing the board game. In an alternate embodiment, the scorecard 50 is electronic with each block containing a light that can be illuminated.

Figure 4:
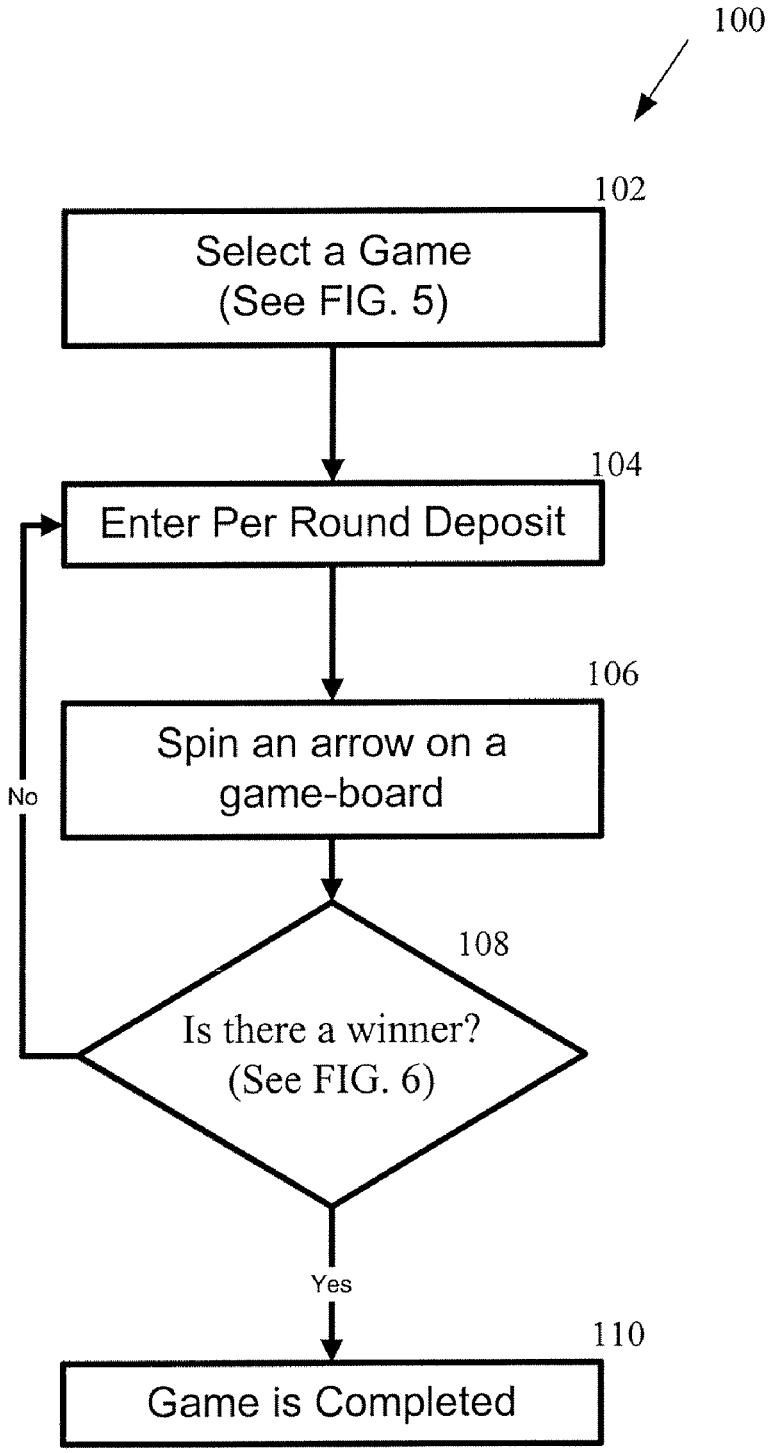
FIGS. 4-6 illustrate flowcharts of an example process for playing the game using the items shown in FIGS. 1-3.

FIG. 4 shows an example process 100 for playing a game using the game board 20 and the scorecards 30, 50. The process 100 begins with a set of players (e.g. two or more players), that select a game, at block 102. Selecting the game is further described in FIG. 5. The players then each deposit a per-round deposit, at block 104. This deposit preferably includes game tokens, game money, and/or currency. Once the players have provided all of the requisite deposits, each player spins the arrow 40 in a predefined order, at block 106. In one embodiment, the order is determined by an initial spin of the arrow 40 and the player who has the highest number goes first, and then in a clockwise manner from the first player. After each spin, the player that made their spin records the inner or outer ring letter/number that the arrow 40 is pointing to, then a decision is made as to whether there is a winner, at decision block 108. The method for determining if there is winner is further explained in FIG. 6. If there is not a winner then the process 100 returns to block 104. If there is a winner then the game is completed, see block 110.

Figure 5:
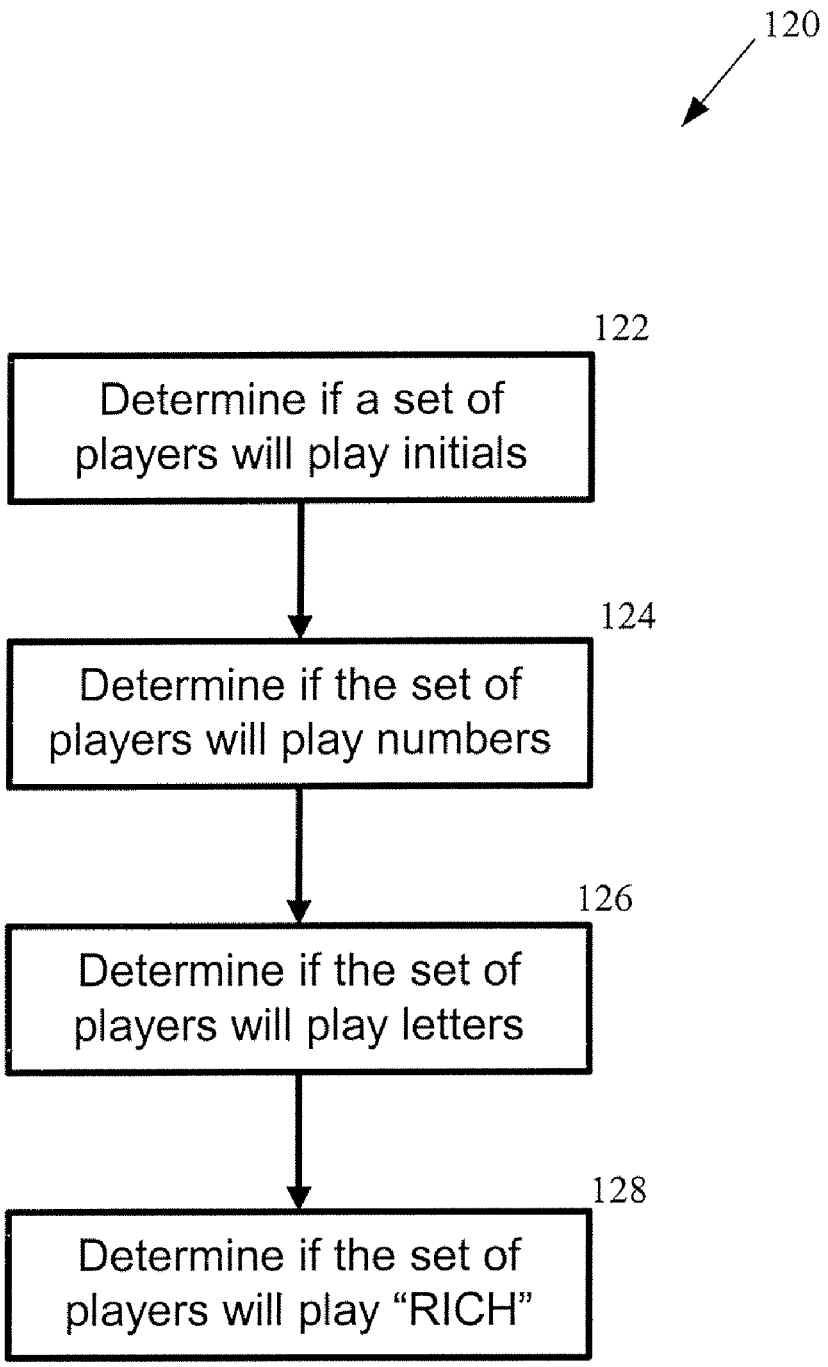

FIG. 5 shows an example process 120 performed at block 102 of FIG. 4. In one embodiment, any combination of the following games can be selected and played concurrently. The process 120 begins with determining whether the players will play their initials, block 122. If the players are playing their initials then each player will write their initials on their scorecard. If the arrow 40 lands on one of their initials when they spin the arrow 40 (not when other players spin), then they will color one of three blocks located next to each initial at section 58 and/or circle the same letter in the initials space 54. Only the player who just spun may mark their initials and nothing happens if another player lands on one of the particular player's initials.

If the players decide to play the numbers, then they will be using the section 56 of the scorecard 50, block 124. Each time the arrow 40 lands on a number, that number is colored in on the main scorecard 30 and the player who spun will color that number on their scorecard. If the players do not play numbers then that portion of the scorecard is omitted.

If the players decide to play the letters then they will be using the section 58 of the scorecard 50, block 126. Each time a player spins and the arrow 40 lands on a letter, that letter is colored in on the main scorecard 30 and the player who spun will color that letter on their scorecard. If the players do not play letters then that portion of the scorecard is omitted.

If the players to decide to play "RICH," the section 60 is used, block 128. If any player spins and the arrow 40 lands on one of the letters in the word "RICH," then it is noted on their scorecard as well as the main scorecard 30. In order to win "RICH" either a particular letter must be spun three times or the word "RICH" must be spelled out. If the word "RICH" is spelled out by a player, then they win. In an alternate embodiment, the game ends once the scorekeeper's scorecard indicates that each of the letters R, I, C, H in the section 60 have at least been pointed to at least once, then the game ends. The amount of money that was included in the deposit then gets then split amongst players who were first to spin the letters R or I or C or H.

Figure 6:
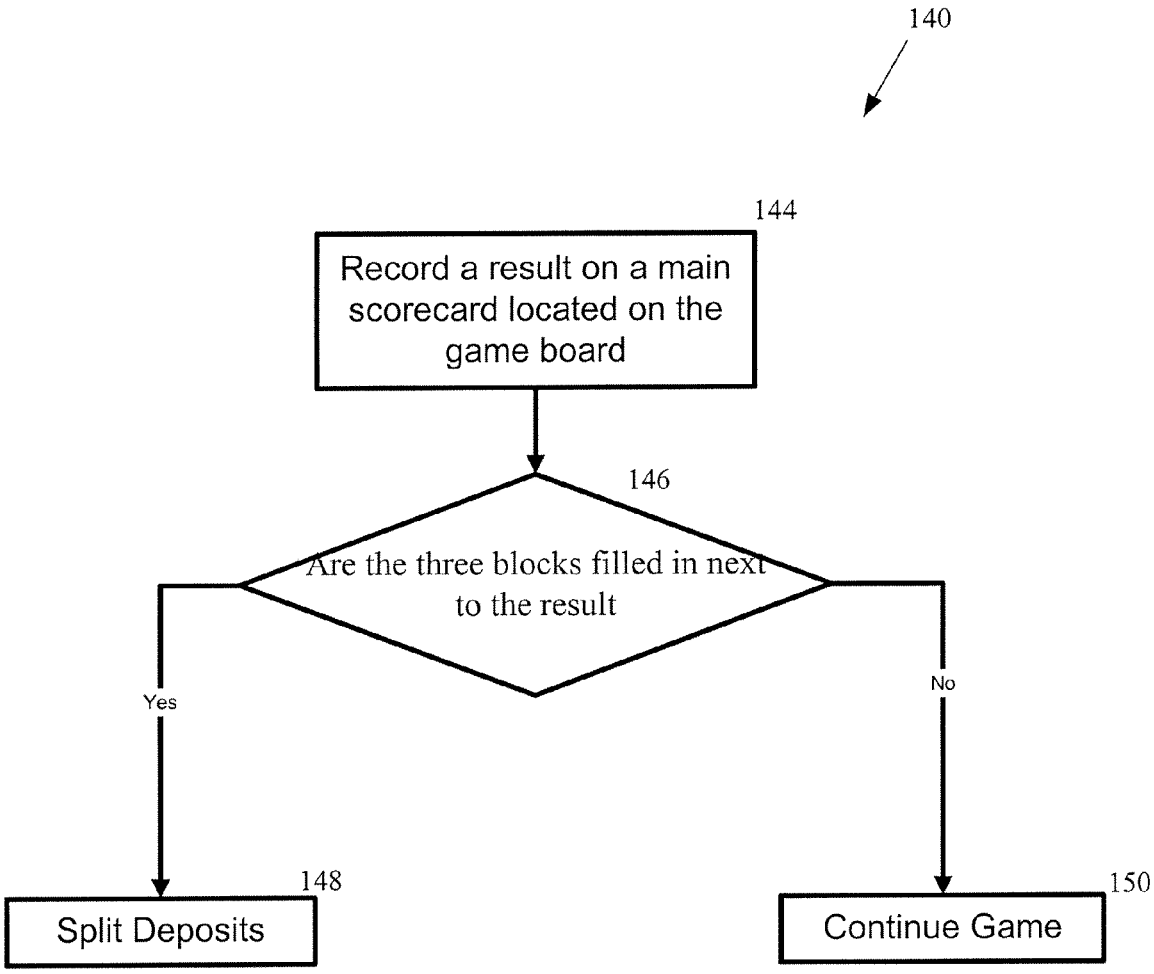

FIG. 6 shows a process 140 of determining if there is a winner of the game. The process 140 begins by recording a result on a main scorecard 30 located on the game board 20, block 144. Once the result is recorded, the process 140 determines whether the three blocks next to any of the letters or numbers in sections 56 and 58 of the main scorecard 30 are colored/filled in (i.e. 3 spins pointed to the letter/number), block 146. If all three blocks are colored, then the deposits are split between those people who spun that letter or number during the game, block 148. If the three blocks next to any number/letter are not filled in, the game is continued, block 150.

The result of a spin is recorded on the main scorecard 30 and on the individual player's scorecard by filling in the square next to the number/letter corresponding to the result of a spin. Each individual player only records their spins on their scorecard, unless the players are playing on teams.

The players who spun the winning number/letter at any time during the current game are identified when the scorekeeper's scorecard 30 has indicated that the game is over. If more than one person spun the winning number/letter, the deposits are split based on how many times each player spun the winning number/letter. In one example, Player A, B and C each spun the winning number 12. Each Player A, B, and C will take ⅓of the deposits. In another example, Player A spun the winning number 12 twice and Player C spun the winning number 12 once. Therefore, Player A will take ⅔'s of the deposits and Player C will take ⅓. If one person spun the winning number/letter three times, all of the deposits go to that player.

Another method of winning the deposits is if the players decided to play the initials game and one of the players spun their initials before anyone else has spun their initials. If this occurs, then that player would take the entire deposit.

If the users decided to also play the "RICH" game, then once the scorekeeper scorecard 30 records at least one hit for each of those four letters, then the game is over. The deposits then would be split amongst the players for only those players that were first to record any of the letters R, I, C or H. For example, if Player A spins and gets an R they would indicate on their scorecard that they were the first to record the R, for example by circling the R and they will also highlight one of the blocks next to R. If Player B then spins and they record a C they would do the same thing except for the letter C. If then Player C over the life of the game was the first to spin an I and also an H they would make similar indications next to the letters I and H. After Player C has spun the H, the scorekeeper determines that all the letters R, I, C and H have been spun and that the game is over. The deposits are split then amongst Players A, B and C, whereby Player C gets 50 percent of the deposits because they had two of the four letters and Players A and B each get 25 percent of the deposits because they had each one of the four letters.

In other embodiments, other formats for determining who winners are or distribution of the deposits at the end of the game may be determined. For example, other words or combinations of numbers or combinations of numbers and words may be a requirement for the game to end and then, of course, determination of the distribution of the deposits would occur. For example, the players may decide to play the word WINNER. Thus, when the scorekeeper records that the letters W, I, N, E, R have been hit and the letter N has been spun twice, then the game would be over and distribution of the deposits would go to those players that were first to hit the letters W, I, N, E and R and also to the player that spun a second N first.

In another embodiment the scorekeeper's scorecard 30 and the scorecards 50 may be made of an easily erasable material depending upon the type of writing device used. For example, the scorecards may be formed of a dry eraser board material that would allow users to mark them with dry erasers.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined a follows:

1. A board game comprising:

a pointing device comprising a first end having a single point and a second end having two points;

a board for rotatably receiving the pointing device, the board comprising:

a first ring around the board having at least one of a plurality of numbers or a plurality of letters; and a second ring having a smaller radius than the first ring having at least one of a plurality of numbers or a plurality of letters;

a scorekeeper's scorecard; and a plurality of player scorecards;

wherein the pointing device includes an indicator end that points to one of the plurality of numbers or plurality of letters in the first and second rings, wherein the scorekeeper's scorecard and the plurality of player scorecards include a listing of the plurality of numbers or plurality of letters and at least one check box positioned adjacent to the each number or letter in the listing, wherein the scorekeeper's scorecard is printed on the board within the rings, wherein the plurality of player scorecards includes a section for entering of players initials, wherein the scorekeeper's scorecard and the plurality of player scorecards include a predefined word section that includes the letters of a predefined word and at least one check box positioned adjacent to each letter of the predefined word, wherein the scorecards include a plurality of rows of numbers and letters that correspond directly to the numbers and letters in the first and second rings and three check boxes are located adjacent to each number and letter in the scorecards.

2. The game device of claim 1, wherein the scorekeeper's scorecard and the plurality of player scorecards include a predefined word section that includes the letters of a predefined word and at least one check box positioned adjacent to the each letter of the predefined word.

3. The game device of claim 2, wherein the predefined word is RICH.

* * * * *